US007353768B1

(12) United States Patent
Jones et al.

(10) Patent No.: US 7,353,768 B1
(45) Date of Patent: Apr. 8, 2008

(54) UNDERWATER VEHICLE PROPULSION AND POWER GENERATION

(75) Inventors: Jack A. Jones, Los Angeles, CA (US); Yi Chao, Arcadia, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 84 days.

(21) Appl. No.: 11/456,441

(22) Filed: Jul. 10, 2006

(51) Int. Cl.
*B63G 8/08* (2006.01)

(52) U.S. Cl. ..... 114/337; 114/312

(58) Field of Classification Search ..... 114/20.1, 114/20.2, 312, 337; 440/3, 6
See application file for complete search history.

(56) References Cited

U.S. PATENT DOCUMENTS 4,609,362 A 9/1986 DeMarco
4,831,297 A 5/1989 Taylor et al.
5,117,141 A * 5/1992 Hawsey et al. ..... 440/6
5,291,847 A 3/1994 Webb
6,371,041 B1 4/2002 Ness
6,645,017 B1 * 11/2003 Skrzypek et al. ..... 440/6
6,807,921 B2 * 10/2004 Huntsman ..... 114/312
6,854,410 B1 2/2005 King et al.
7,077,072 B2 * 7/2006 Wingett et al. ..... 114/312
2003/0167998 A1 * 9/2003 Huntsman ..... 114/312

* cited by examiner

*Primary Examiner*—Lars A Olson
(74) *Attorney, Agent, or Firm*—Mark Homer

(57) ABSTRACT

An underwater vehicle includes a shaft with a propeller disposed thereon; a generator/motor having a stator and a rotor, the rotor being operable to rotate with the propeller; at least one energy storage device connected to the generator/motor; and a controller for setting the generator/motor in a charge mode, a propulsion mode and an idle mode.

25 Claims, 2 Drawing Sheets

UNDERWATER VEHICLE PROPULSION AND POWER GENERATION

STATEMENT OF GOVERNMENT INTEREST

The invention described hereunder was made in the performance of work under a NASA contract, and is subject to the provisions of Public Law #96-517 (35 U.S.C. 202) in which the Contractor has elected not to retain title.

BACKGROUND OF THE INVENTION

The invention relates in general to underwater vehicles and in particular to power generation for underwater vehicles.

Autonomous underwater vehicles require electricity for propulsion, communication and/or to power scientific instruments. There is a known method of propulsion that does not use electricity. This method relies on temperature differences in the ocean to propel the vehicle. However, underwater vehicles need electricity for uses other than propulsion, primarily communications and power for scientific instruments. Batteries can supply power for only a limited time. Thus, there is a need for a renewable source of electrical power for underwater vehicles.

SUMMARY OF THE INVENTION

It is an object of the invention to provide an apparatus and method for generating electricity for an underwater vehicle.

It is another object of the invention to provide a supplemental source of propulsion power for an underwater vehicle.

One aspect of the invention is an underwater vehicle comprising a shaft with a propeller disposed thereon; a generator/motor having a stator and a rotor, the rotor being operable to rotate with the propeller; at least one energy storage device connected to the generator/motor; and a controller for setting the generator/motor in a charge mode, a propulsion mode and an idle mode.

Another aspect of the invention is a method comprising moving the underwater vehicle as described above through water; setting the controller to the charge mode; and charging the at least one energy storage device.

Still another aspect of the invention is a method comprising providing the underwater vehicle as described above; setting the controller to the propulsion mode; and providing power to the propeller from the generator/motor.

A further aspect of the invention is a method comprising providing the underwater vehicle as describe above; and setting the controller to the idle mode.

Yet another aspect of the invention is, in an underwater vehicle, a propulsion and power generation apparatus comprising a shaft with a propeller disposed thereon; a generator/motor having a stator and a rotor, the rotor being operable to rotate with the propeller; at least one energy storage device connected to the generator/motor and a controller for setting the generator/motor in a charge mode, a propulsion mode an idle mode.

A still further aspect of the invention is an underwater vehicle comprising a shaft with a propeller disposed thereon; a generator connected to the shaft; at least one energy storage device connected to the generator; and a controller for setting the generator in a charge mode or and an idle mode.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention relates to autonomous underwater vehicles (UVs) used to study the ocean. Such vehicles require electricity for the operation of scientific instruments and for transmitting information to external locations. Some vehicles also use electricity for propulsion.

For primary propulsive power, there are known methods of using temperature gradients in the ocean to vary the buoyancy of an UV, which causes the UV to move vertically. This vertical motion can be harnessed to move the UV horizontally also. U.S. Pat. No. 5,291,847 issued on Mar. 8, 1994 discloses a method of propelling an UV by using the temperature differentials in the ocean water. When the UV is moving both vertically and horizontally, it is said to be "gliding." The present invention extracts energy from the gliding movement of the UV and uses it to provide electrical power to the UV. The energy that is extracted from the gliding movement is stored onboard the UV.

Figure 1:
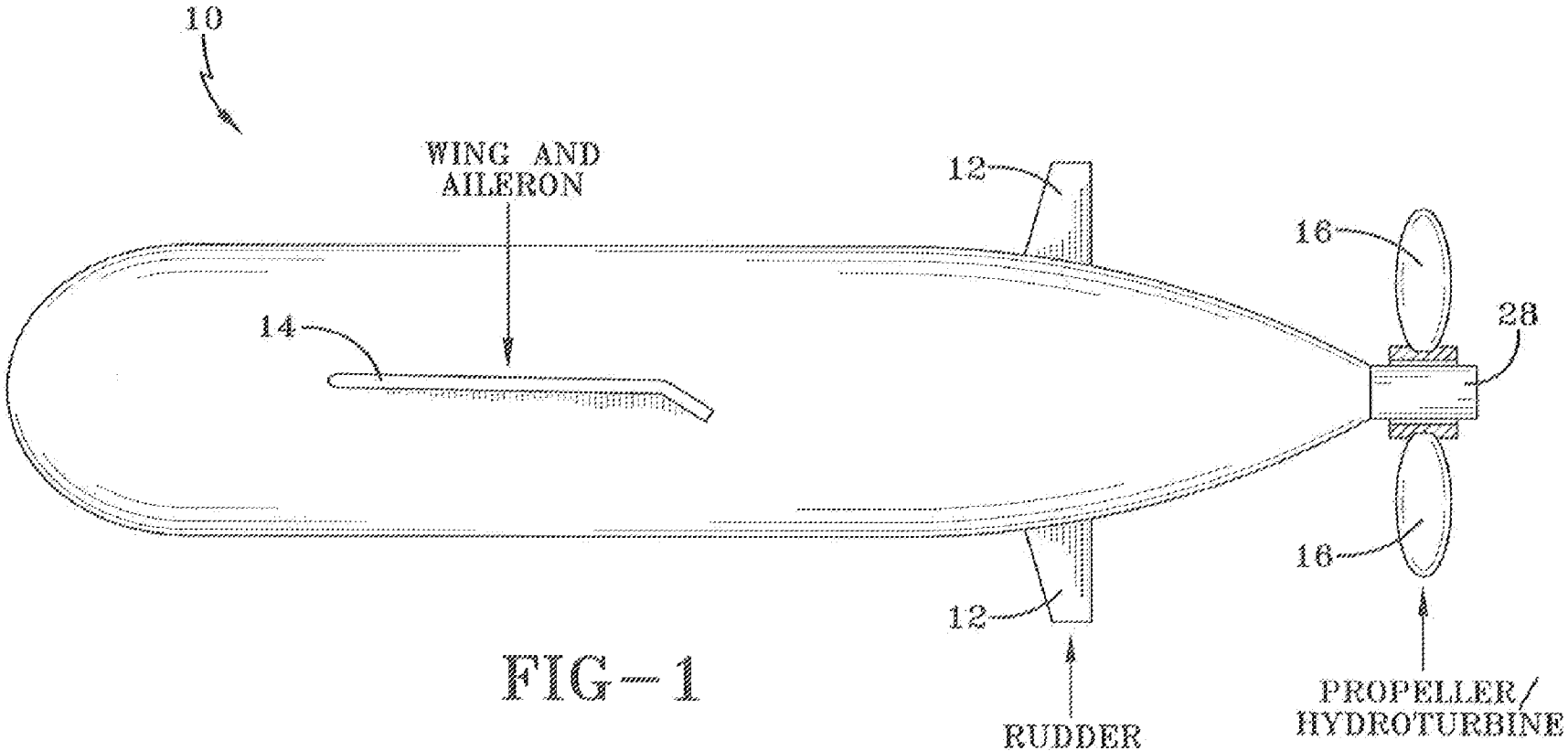
FIG. 1 is a side view of one embodiment of an underwater vehicle in accordance with the invention.

FIG. 1 is a side view of one embodiment of an UV 10 in accordance with the invention. UV 10 may include features for steering, such as rudders 12 and wings 14 having ailerons. A propeller or hydroturbine 16 is mounted on a shaft 28, generally at the rear of the UV 10. Rotation of propeller 16 causes forward motion of the UV 10, in a known manner.

Figure 2:
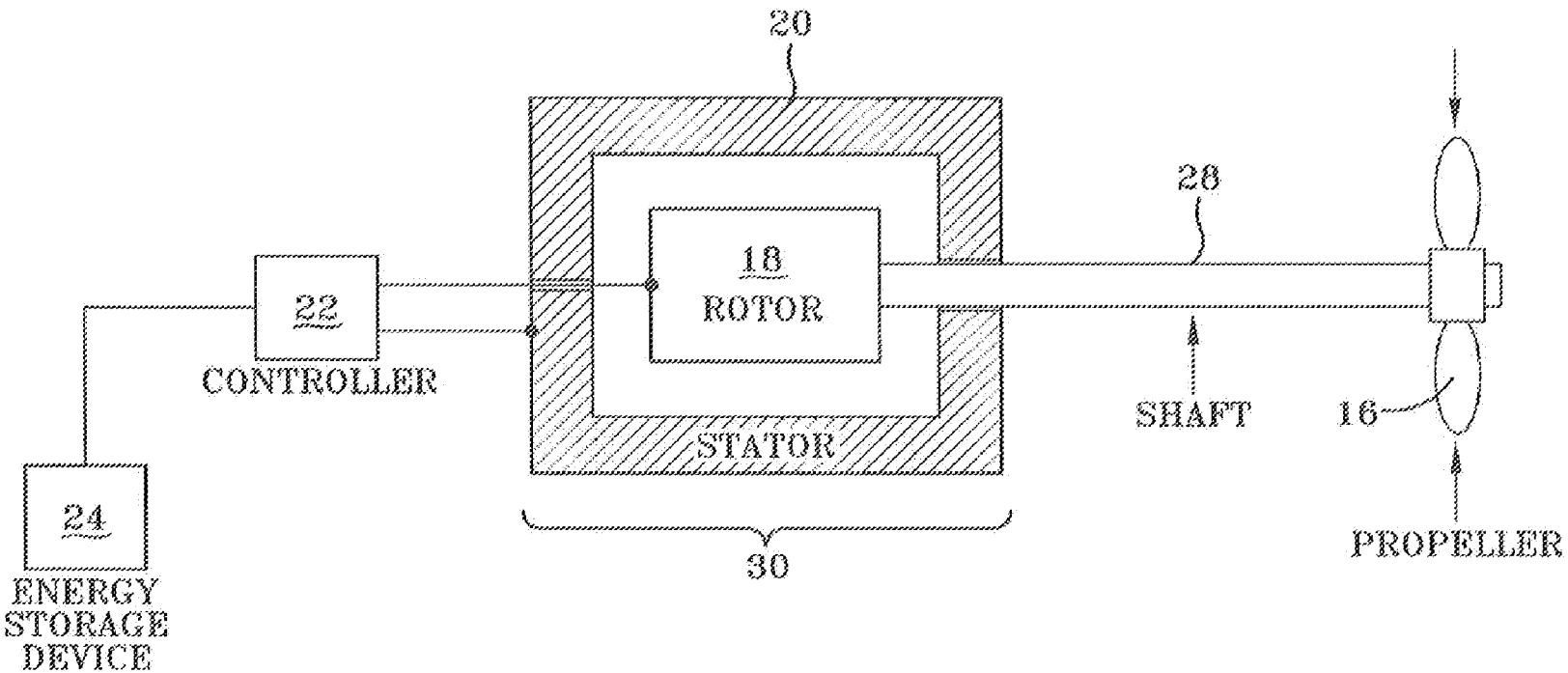
FIG. 2 schematically shows one embodiment of an electrical generation apparatus for an underwater vehicle.

FIG. 2 schematically shows one embodiment of an electrical generation apparatus for the UV 10. The propeller 16 is disposed on a shaft 28. An electric generator/motor unit 30 comprises a rotor 18 and stator 20. Rotor 18 is operable to rotate with propeller 16 and may be disposed on the shaft 28. At least one energy storage device 24 is connected to the generator/motor 20. In a preferred embodiment, the energy storage device 24 is an electrical energy storage device, such as a battery or capacitor. Energy storage devices 24 other than electrical energy storage devices, such as flywheels, thermal capacitance heat storage, compressed gas, etc. may also be used, and may require additional motors, controllers, heaters, thermoelectric generators, pumps, or other devices to facilitate the energy transfer. While the propeller 16 is disposed outside the body of the UV 10, the generator/motor 30 may be disposed inside or outside of the body and sealed suitable. An example of a submersible motor is shown in U.S. Pat. No. 4,831,297 issued on May 16, 1989.

A controller 22 provides a means for setting the generator/motor 30 in a charge mode, a propulsion mode and an idle mode. The controller 22 adjusts the electrical current flow and voltage to optimize the desired operating mode. Examples of such controllers are used in hybrid automobile technology. The controller 22 may be operated automatically by a command external to the UV 10. Controller commands may be sent to the UV 10 via sonar, or, if the UV 10 is near the water surface, via radio.

When the UV is "gliding" as defined above, the propeller 16 is forced to rotate. If the controller 22 is in the idle mode, then the generator/motor circuit is open and the propeller 16 causes a minimal drag force. If the controller 22 is in the charge mode, then the propeller 16 and rotor 18 are rotating. The generator/motor 30 is acting as a generator and electric power is being sent to the energy storage device 24 to charge it. If the UV needs to quickly move to a certain area, the controller 22 is put in the propulsion mode. The polarity of the electric current in the generator/motor 30 is reversed and the generator/motor acts as a motor by sending power to the shaft 28 and propeller 16. In the propulsion mode, the speed of gliding is increased by the power sent to the propeller 16 by the generator/motor 30.

Whether the propeller is charging the energy storage device (charge mode) or providing propulsion force to the UV (propulsion mode), the propeller 16 always rotates in the same direction. It is the polarity of the electric current in the generator/motor 30 that is reversed, depending on the mode of operation. In summary, there are three modes of operation. The charge mode is when the UV 10 is gliding and the propeller 16 is rotating and generating electricity to charge the energy storage device 24. The idle mode is when the propeller 16 is essentially electrically "unhooked" from the generator/motor 30 and freely turning, to reduce the drag on the UV. The propulsion mode uses the generator/motor 30 as an electrical motor to turn the propeller 16 and provide propulsion to the UV 10.

In an alternate embodiment, the propulsion mode may be omitted so that the propeller 16 is either charging the energy storage device 24 (charge mode) or is free-wheeling (idle mode). In this embodiment, the generator/motor 30 only functions as a generator.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An underwater vehicle, comprising:
- a shaft with a propeller disposed thereon;
- a generator/motor having a stator and a rotor, the rotor being operable to rotate with the propeller;
- at least one energy storage device connected to the generator/motor; and
- a controller for setting the generator/motor in a charge mode, a propulsion mode and an idle mode.

2. The underwater vehicle of claim 1 wherein the rotor is disposed on the shaft.

3. The underwater vehicle of claim 1 wherein in the charge mode the generator/motor charges the at least one energy storage device.

4. The underwater vehicle of claim 1 wherein in the propulsion mode the generator/motor provides power to the propeller.

5. The underwater vehicle of claim 1 wherein in the idle mode the generator/motor is an open circuit.

6. A method, comprising:
- moving the underwater vehicle of claim 1 through water;
- setting the controller to the charge mode; and
- charging the at least one energy storage device.

7. A method, comprising:
- providing the underwater vehicle of claim 1;
- setting the controller to the propulsion mode; and
- providing power to the propeller from the generator/motor.

8. A method, comprising:
- providing the underwater vehicle of claim 1;
- setting the controller to the idle mode.

9. The underwater vehicle of claim 1 wherein the at least one energy storage device is an electrical energy storage device.

10. The underwater vehicle of claim 9 wherein the electrical energy storage device is a battery.

11. In an underwater vehicle, a propulsion and power generation apparatus, comprising:
- a shaft with a propeller disposed thereon;
- a generator/motor having a stator and a rotor, the rotor being operable to rotate with the propeller;
- at least one energy storage device connected to the generator/motor; and
- a controller for setting the generator/motor in a charge mode, a propulsion mode and an idle mode.

12. The apparatus of claim 11 wherein the rotor is disposed on the shaft.

13. The apparatus of claim 11 wherein in the charge mode the generator/motor charges the at least one energy storage device.

14. The apparatus of claim 11 wherein in the propulsion mode the generator/motor provides power to the propeller.

15. The apparatus of claim 11 wherein in the idle mode the generator/motor is an open circuit.

16. The apparatus of claim 11 wherein the at least one energy storage device is an electrical energy storage device.

17. The apparatus of claim 16 wherein the electrical energy storage device is a battery.

18. An underwater vehicle, comprising:
- a shaft with a propeller disposed thereon, the propeller capable of propelling the vehicle through water;
- a generator connected to the shaft;
- at least one energy storage device connected to the generator; and
- a controller for setting the generator in a charge mode or and an idle mode.

19. The underwater vehicle of claim 18 wherein the generator comprises a generator/motor having a rotor and a stator, the rotor being operable to rotate with the propeller and further wherein the controller is for setting the generator/motor in a propulsion mode.

20. The underwater vehicle of claim 19 wherein the rotor is disposed on the shaft.

21. The underwater vehicle of claim 19 wherein in the propulsion mode the generator/motor provides power to the propeller.

22. The underwater vehicle of claim 18 wherein in the charge mode the generator charges the at least one energy storage device.

23. The underwater vehicle of claim 18 wherein in the idle mode the generator is an open circuit.

24. The underwater vehicle of claim 18 wherein the at least one energy storage device is an electrical energy storage device.

25. The underwater vehicle of claim 24 wherein the electrical energy storage device is a battery.

* * * * *